US007337569B2

(12) United States Patent
Glass

(10) Patent No.: US 7,337,569 B2
(45) Date of Patent: Mar. 4, 2008

(54) PORTABLE SIGN FRAME ASSEMBLY WITH CHANGEABLE SIGNAGE

(75) Inventor: Geoffrey M. Glass, Skokie, IL (US)

(73) Assignee: American Louver Company, Skokie, IL (US)

( * ) Notice: Subject to any disclaimer, the term of this patent is extended or adjusted under 35 U.S.C. 154(b) by 0 days.

(21) Appl. No.: 11/198,476

(22) Filed: Aug. 5, 2005

(65) Prior Publication Data

US 2006/0032098 A1 Feb. 16, 2006

Related U.S. Application Data

(60) Provisional application No. 60/601,739, filed on Aug. 13, 2004.

(51) Int. Cl.
*G09F 15/00* (2006.01)
*E01F 9/00* (2006.01)

(52) U.S. Cl. ..... 40/610; 116/63 P

(58) Field of Classification Search ..... 40/610; 116/63 P

See application file for complete search history.

(56) References Cited

U.S. PATENT DOCUMENTS

| | | | | |
|---|---|---|---|---|
| 381,766 | A | 4/1888 | Deuther | |
| 824,125 | A | 6/1906 | Little | |
| 1,115,021 | A | 10/1914 | Pummill | |
| 2,075,401 | A | 3/1937 | Mosby | |
| 2,723,817 | A | 11/1955 | Harwood et al. | |
| 2,864,191 | A | 12/1958 | Hagen | |
| 3,969,838 | A * | 7/1976 | Moore | 40/611.06 |
| 4,005,537 | A | 2/1977 | von Camber et al. | |
| 4,098,009 | A * | 7/1978 | Flynn | 434/88 |
| 5,382,112 | A | 1/1995 | Fu | |
| 6,393,748 | B1 * | 5/2002 | Cooper | 40/610 |
| 6,615,523 | B1 * | 9/2003 | Curbelo et al. | 40/606.15 |
| 6,651,367 | B1 | 11/2003 | Barragan | |
| 6,694,896 | B1 * | 2/2004 | Milazzo | 108/115 |

OTHER PUBLICATIONS

"Sign-Holders Supply" by Marv O lus Mfg. Co., Inc., 2002-2003 Catalog.

* cited by examiner

*Primary Examiner*—Cassandra Davis
(74) *Attorney, Agent, or Firm*—Brinks Hofer Gilson & Lione

(57) ABSTRACT

A sign frame assembly having journally connected frames and appearing as an inverted "V" when deployed on a surface. Each frame has legs connected by a panel, and upper and lower crossbars which are parallel to each other and connect the legs. A receptacle defined by a plane including the panel and which is parallel to and separated from a plane formed by surfaces of the legs, and the upper and lower cross bars is provided to hold a flat object which may be used as a sign. The flat object may be inserted and removed without the use of tools or fasteners.

21 Claims, 8 Drawing Sheets

PORTABLE SIGN FRAME ASSEMBLY WITH CHANGEABLE SIGNAGE

This application claims the benefit of priority to provisional application 60/601,739, filed on Aug. 13, 2004, which is incorporated herein by reference.

TECHNICAL FIELD

This invention relates generally to a portable sign stand and to a sign stand and sign assembly.

BACKGROUND

Portable sign stands and signs are used for many purposes, such as advertising, providing directions to pedestrians or vehicles and serving as safety warnings. In some situations, signs of this type may be used to advertise special events, sales at a nearby store, or the availability real estate for sale. These signs may be of a temporary nature, and the user of the sign has to transport the sign with the sign stand to the desired location and set it up. The person performing this action may not have a special purpose vehicle, and the function of erecting the sign stand may be an ancillary duty. Ease of assembly and set-up, weight, durability and the ability to change the signage to that appropriate for the occasion may be concerns.

SUMMARY

This application describes a sign stand which may be deployed such that it displays a sign selected by the user, and the sign may be changed by the user as needed.

The sign stand comprises two frames, journally connected to each other at one end by one or more hinges, permitting the two frames to be folded flat for transportation or storage, and permitting the two frames to be configured in the shape of an inverted "V" when deployed.

At least one frame includes a receptacle for receiving and retaining a sign dimensioned such that it can be inserted into and retained by the frame, the sign having been prepared to display information visible to a person viewing the sign that is positioned within the receptacle when the frame has been deployed for use. The frame includes a pair of legs connected by a panel. Also connecting the legs, near the leg ends distal from the hinge, is a cross bar (the "lower" cross bar) having a channel shape. The channel may be of a "U", "L", "J" or similar configuration, so long as one of the vertical portions of the channel faces towards the person viewing the sign. (The use of a serif or san-serif character for the written description of the "L" neither requires nor prohibits the formation of a lip on the end of a bottom surface distal from the vertical surface.) The legs are spaced apart such that the horizontal dimension between the legs it is equal to or greater than the width of a sign to be displayed. Another cross-bar (the "upper" cross bar) connects the legs at the ends proximal to the hinge, being spaced from the top of the frame, and being spaced closer to the person viewing the sign than is the panel.

The panel is disposed between the two legs such that a plane coincident with a facing surface thereof is further from the person viewing the sign than a plane containing each of the upper and lower cross bar. This panel, or an extension of the plane of the facing surface thereof, in conjunction with the upper and lower cross bars, forms the receptacle for receiving and displaying the sign, and a structure for retaining the sign. The panel may be constructed so as to have apertures formed therein, be of a corrugated shape, or have one or more cross members disposed so as to lie in a plane, and when cooperating with the upper and lower cross bars having the effect of restraining the rear and front surfaces of the sign. The bottom of the sign is restrained against the force of gravity by the bottom of a channel or a horizontal ledge in the lower cross member. The details of the panel are a matter of engineering design choice, balancing such factors as rigidity of the overall structure, weight, and ease of fabrication, and structural aspects of the sign to be inserted in the sign frame. One such panel arrangement may deploy a cross member facing each of the upper and lower cross-bars, and lying in the panel plane.

A vertical dimension between the bottom edge of the upper cross bar and a bottom of an interior surface of the lower cross bar is sized such that it is smaller than a vertical dimension of the sign. A viewable area of the sign may be located within an aperture formed between the two side legs, the upper cross bar and the lower cross bar. The sign can be placed behind the aperture which is bounded by the legs and the upper and lower cross bars, by sliding the sign into the receptacle between the upper cross bar and the facing surface of the panel such that the sign comes in contact with the bottom of the lower cross bar.

The terms "channel", "horizontal ledge" or "horizontal surface" are used to mean that portion of the lower cross bar which has the effect of restraining the motion of the sign against the force of gravity. In this manner, an appropriately dimensioned sign is retained in the receptacle by a vertical side of the lower cross bar and by the upper cross bar in the direction facing an observer, by the panel in the direction away from the observer, and by a horizontal portion of the lower cross bar in the vertical direction. The same features as described may also be present on a second frame of the sign frame, so that signs may be displayed in more than one direction to an observer. Each frame may have a plurality of apertures, each aperture having features as previously described.

The sign stand and sign assembly can be deployed in the form of an inverted "V", and a flexible member can be connected between adjacent legs on opposing frames of the sign frame assembly, the flexible member being dimensioned such that the maximum angle between the frames of the sign stand can be restricted. Alternatively, one or more tabs may be formed at the upper edge of the top of a frame, the tabs projecting in a direction opposed to the lower cross-bar, and extending such that the distal end of the tab is further from the top of the frame than the axis of the hinge. Tabs on the two frames are disposed opposite each other, and make contact when the sign frames are rotated with respect to each other about the hinge; this serves to limit the maximum acute angle which can be formed between the frames.

In another embodiment, the vertical dimension of the sign is at least equal to the depth of the lower cross bar plus the distance between the upper edge of the lower cross bar and the bottom edge of the upper cross bar. The depth of the lower cross bar is defined as the distance between the upper edge of the lower cross bar and the interior surface of the bottom of the channel or of the ledge of the lower cross bar. In this manner, an appropriately dimensioned sign may be inserted in the receptacle formed by the panel and the upper and lower cross bars. One method of inserting the sign is to position the sign such that the bottom of the sign is higher than the upper edge of the upper cross bar, and the top of the sign is positioned between the plane containing the inner portions of upper cross bar and the lower cross bar, and the plane containing the facing surface of the panel. The bottom of the sign is moved downwards such that it occupies a plane between that of the lower cross bar and the facing surface of the panel or an extension of the plane thereof, and the sign is moved, or permitted to move, such that the bottom of the sign rests on a bottom inner surface of the lower cross bar, and is retained by inner vertical surfaces of the upper and lower cross bars. An alternative method of insertion of the sign, described subsequently, can also be used to insert the sign in the previously described embodiments.

In the manufacture of a sign frame, it will be appreciated that the materials may deviate from precise rectilinear shapes, and that it may be necessary to temporarily deflect one or more of the cross bars or the panel in order to insert the sign.

In another embodiment, the panel wall is used to connect the two legs of one frame of the sign stand, and the panel is positioned such that it substantially fills the aperture in the frame.

The sign can be made of a lightweight material, such as paper, cardboard or thin plastic, since the wall panel can reduce sign deflection due to wind forces, although all types of material conventionally used for fabricating signs can be used. The distance between the plane defined by the facing surface of the panel, and the plane defined by the inner surface of the upper cross bar and the inner vertical surface of the lower cross bar is sized such that at least one sign can be contained within the volume so defined. Depending on the thickness of the signs, more than one sign may be accommodated in this volume, although only one sign may be visible in each aperture of the frame. Signs may be stored and carried in the frame, and may remain in the sign frame assembly during transportation, storage or deployment. This provides for multiple signs which may be conveniently changed by a person.

In yet another embodiment, the upper cross bar is formed such that it is connected to a top of the sign frame such that a continuous surface exists above the top of the upper cross-bar. In this manner, the entry of water may be mitigated. Alternatively, the top of the sign frame can extend outward so as to overlap the top of the upper cross bar and achieve a similar result. The sign may be inserted in the frame receptacle by bringing a top edge of the sign to a location below the lower edge of the upper cross bar, and between the plane formed by the panel facing surface, or an extension thereof, and the plane formed by inner surfaces of the upper and lower cross bars. The sign is translated upwards so as to enter the gap formed by the inner surface of the upper cross bar and the panel, or the plane formed by the panel facing surface so that it enters the receptacle, and that the lower edge of the sign is positioned above the upper edge of the lower cross bar. While maintaining this orientation where the upper edge of the sign has been inserted into the receptacle between the lower edge of the upper cross bar and the panel, or the plane defined by the facing surface thereof, the sign is rotated so that it lies between the two planes, and is then translated towards the lower cross bar so that it comes in contact with the inner bottom surface of the lower cross bar. Providing that the sign is appropriately dimensioned, it will be retained in the frame by the bottom surface of the lower cross bar, inner vertical surfaces of the upper and lower cross bars, and the panel, which collectively form the receptacle.

The sign stand is deployed in the form of an inverted "V", and a flexible member may be connected between adjacent legs on opposing frames of the sign stand, the flexible member being dimensioned such that the maximum angle between the frames may restricted. Alternatively, one or more tabs may be formed at the upper edge of the top of a frame, the tabs projecting in a direction opposed to the lower cross bar, and extending such that the distal end of the tab is further from the top of the frame than the axis of the hinge.

A carrying handle may be formed in or added to the top of one or both of the sign frames, and a sand bag bar positioned below the lower cross bar as an additional cross bar structure such that the resistance to overturning due to wind forces can be increased if needed. Also, frames may have hollow areas which can accept sand or other granular material, such that the resistance to overturning due to wind can be increased if needed.

Each of the sign frames may be molded as an integral structure, comprising the legs, the panel, the upper and lower cross-bars, and one portion of a mating hinge assembly. Alternatively, the sign frames may be assembled from multiple components. The mating hinge assemblies of two frames are joined such that the frames may rotate about the hinge. The sign frame may also be fabricated without a hinge assembly for use in applications where only a single sign frame is desired.

In another aspect, the sign stand may be comprised of the front portions of two sign frames, opposed to each other, and separated by a panel, the panel being any of the configurations previously described, such that two signs may be individually displayed, each sign facing in a direction opposed to the other. The sign stand may be constructed in this manner as an integral assembly. The sign stand may either by hung from the top portion thereof, using hooks or slots to engage hooks, or the like. Alternatively, the sign stand may be provided with a base such that the sign stand is supported in a vertical position when placed upon a horizontal surface. The base may be integral with the sign stand.

In yet another aspect, the panel may be attached between the top of the sign and the edge of the horizontal ledge of the bottom cross bar that is distal from the vertical surface of the bottom cross bar. In this configuration, the panel may not be connected between the two legs, although such a configuration is not precluded.

In still another aspect, a slot may be provided in one of the side legs, the slot being at least as long as the vertical dimension of a sign to be inserted, and having a width equal to at least the thickness of one sign. The slot is disposed on a surface of a leg, such that a sign may be inserted through the slot and pass into the receptacle in front of the panel. A sign inserted into the slot may be slid until a vertical edge thereof contacts the leg opposing the leg having the slot. In this state, a horizontal edge of the sign also rests on the horizontal portion of the lower cross bar. The slot is positioned in the leg so that a lower extremity thereof is at least as far from the base of the sign as the inner surface of the horizontal ledge.

DETAILED DESCRIPTION

Exemplary embodiments may be better understood with reference to the drawings, but these embodiments are not intended to be of a limiting nature. Like numbered elements in the same or different drawings perform equivalent functions.

Figure 1:
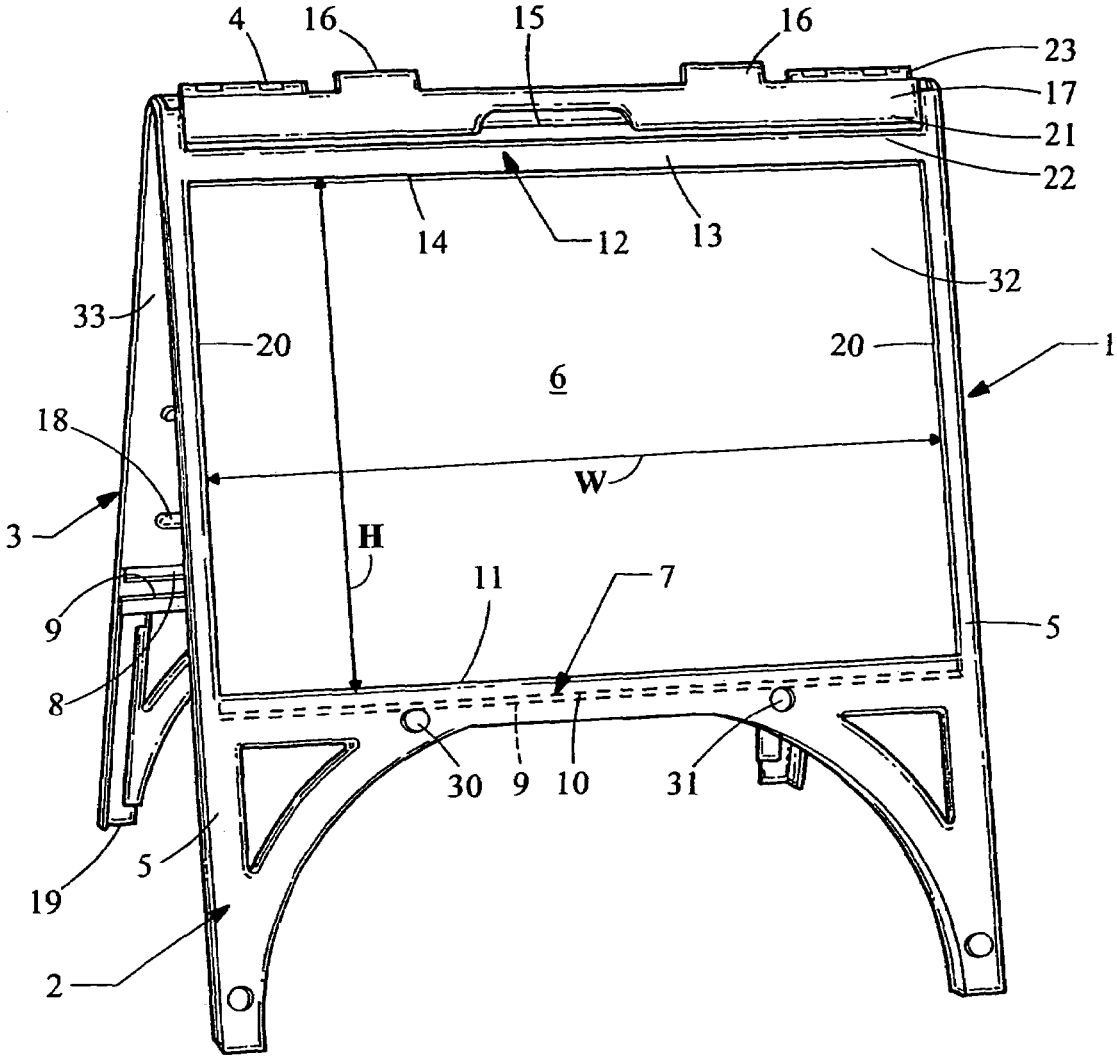
FIG. 1 is a perspective view of an embodiment of a sign stand assembly.

In an embodiment as shown in FIG. 1, a sign stand 1 is comprised of a pair of frames 2, 3, journally connected at the top by one or more hinges 4. The hinges 4 may be integrally molded with the corresponding frames. Each frame has two side legs 5 connected by a panel 6 disposed between the two legs, the panel occupying some portion of the distance between the top of the frame 17 and the bottom 19 of each leg 5.

A receptacle 8 is defined by the horizontal distance W between the opposing interior edges 20 of the side legs 5 and the vertical distance H between the lower edge 14 of a upper cross bar 12 and the upper edge 11 of a lower cross bar 7, each cross bar being parallel to the other, the upper cross bar 12 and the lower cross bar 7 joining opposing legs 5 of a frame 2, 3. The distance W is greater than or equal to the width of a sign which is intended to be inserted into the aperture, as described subsequently. The distance H plus a distance equal to the distance between the inner lower surface 9 of the lower cross bar 7 and the top edge 11 of lower cross bar is less than a height of a sign which is intended be inserted into the aperture. A spacing S between a plane defined by the inner surfaces of the inner surfaces of the cross bars which oppose the outer surfaces 10 and 13 of the cross bars 7 and 12, and the facing side 32 of the panel 6 or an extension of a plane defined thereby, is greater than or equal to the thickness of a sign which is to be accommodated therebetween.

Tabs 16 may be formed, integral with a top portion 17 or applied thereto, such that corresponding tabs on two frames oppose each other. The height of the upper end of the tab is at a greater distance from the top portion 17 than the pin 23 of the hinge. When the sign frames 2, 3 are rotated about the hinge 4 such that an acute angle is formed therebetween, the opposing top portions of the tabs 16 come into contact and act to restrain a further increase in opening angle. Alternatively, this restraining function may be performed by a flexible member, such as a cord or chain (not shown), connected between a leg of opposing frames.

A carrying handle, which can be in the form of an aperture 15 in the top 17 of one or more frames, may facilitate transportation and deployment of the sign frame assembly. The handle can also be formed as an appendage to at least one of the frames, or as a separate attached part.

The lower cross bar 7 can be in the form of an "L" as depicted in FIG. 1, or in the from of a "U" or "J", where the inner bottom surface of the "U" or "J" is oriented such that it faces towards the top of the frame, and acts to resist the force of gravity operating on a sign which has been inserted in the frame.

The panel 6 may be integrally molded with the legs and other portions of a frame. The plate may be flat, or have a deformed or corrugated shape, or be perforated, or be formed of one or more cross members.

Each of the frames may have bosses 30, or recesses 31 on an exterior surface, dimensioned and positioned such that a boss and a recess can mate, and disposed on the frames 2, 3 such that bosses mate with the recesses on another sign stand which may be laid on top thereof. In this manner, sign frame assemblies may be stacked for transportation and storage. A sign stands have both bosses and recesses on the same exterior surface.

The sign stand frames may be fabricated from various materials, which may include molded plastic, composite materials, metals or wood. The selection of materials may depend on specific use, manufacturing, durability and esthetic requirements.

The sign 25 may be fabricated of corrugated plastic such as Coroplast, hardboard, foam board, aluminum sheet, plastic sheet, plasticized paper or metal, or other suitably dimensionally material, the material being selected for properties relating to printing or other process of applying printing, photography, decoration, or relief. Signs may contain information on either one or both sides thereof. Generally, only one side of the sign is visible to an observer, but the signs can contain information on both sides, so that the sign may be removed from the frame and reinserted so as to display the opposite surface to an observer. Alternatively, one of the frames can be used alone, and hung from a support such that both sides of the sign are visible to observers on opposite sides of the frame. Such a frame may have additional structural elements or hardware to facilitate hanging from the support.

Figure 2A:
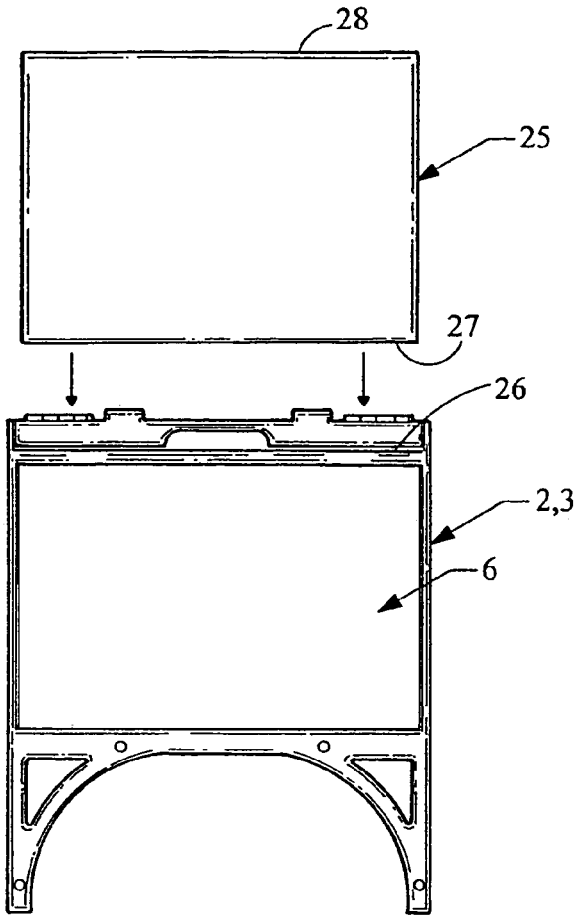
FIG. 2 is elevation view of one of the sign stand frames showing a method of introducing a sign into the frame.
Figure 2B:
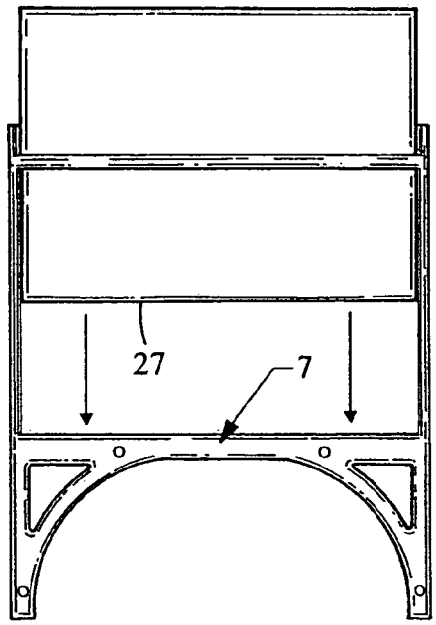
Figure 2C:
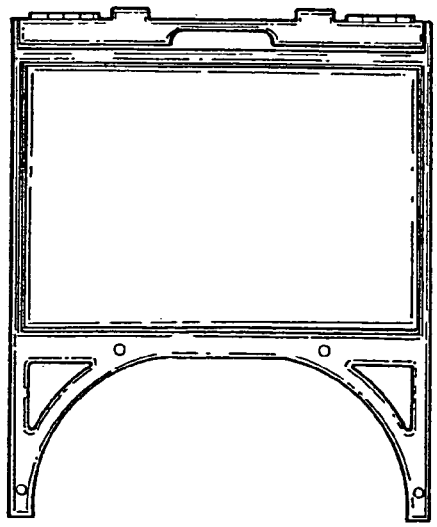

FIG. 2 illustrates a method of inserting a sign 25 in a frame 2, 3. The sign insertion may be performed either when the frames are rotated such that they are parallel to each other (the collapsed position), or when they are disposed such that an acute angle is formed by the frames (the deployed position) with respect to the top of the sign stand (the hinge end). The sign 25 is positioned approximately parallel to the panel 6, and above the upper cross bar 12. The sign 25 is guided such that it enters the slot 26 formed by an inner surface of the upper cross bar 12 and a facing surface 32 of the panel 6, or plane which is coplanar with the facing surface of the panel. Continuing the motion approximately parallel to the facing surface 32 of the panel 6, the sign 25 is translated such that it comes in contact with the inner bottom surface 9 of the lower cross bar 7. When the sign 25 is in contact with the inner bottom surface 9, gravitational force maintains the bottom edge 27 of the sign in contact with the inner bottom surface 9. The upper edge 28 of the sign 25 is thus positioned such that it is behind the upper cross-bar 12, and is retained between the panel 6, the inner bottom surface 9, the inner vertical surface 8 of the lower cross-bar 7 and the inner surface of the upper cross-bar 12, the inner surfaces of the upper and lower cross bars opposing a plane which is coplanar with the facing surface 32 of the panel 6.

More than one sign 25 may be accommodated in the aperture of each of the frames. The number of signs 25 that may be accommodated depends on the ratio of the distance S to the sum of the thicknesses of the signs to be accommodated. The signs need not all be of the same thickness or material. In this manner, a number of signs, capable of displaying, for example, but not by way of limitation, different messages, designs, surface colors, textures and reflectivities may be conveniently stored therein and the operator can change the sign to be displayed as required. As the signs are retained in the frame, the sign frame assembly, including the signs, may be transported, stored and deployed as a unit, and the appropriate sign selected as required. Each sign can be removed from the frame by reversing the process previously described.

Figure 3:
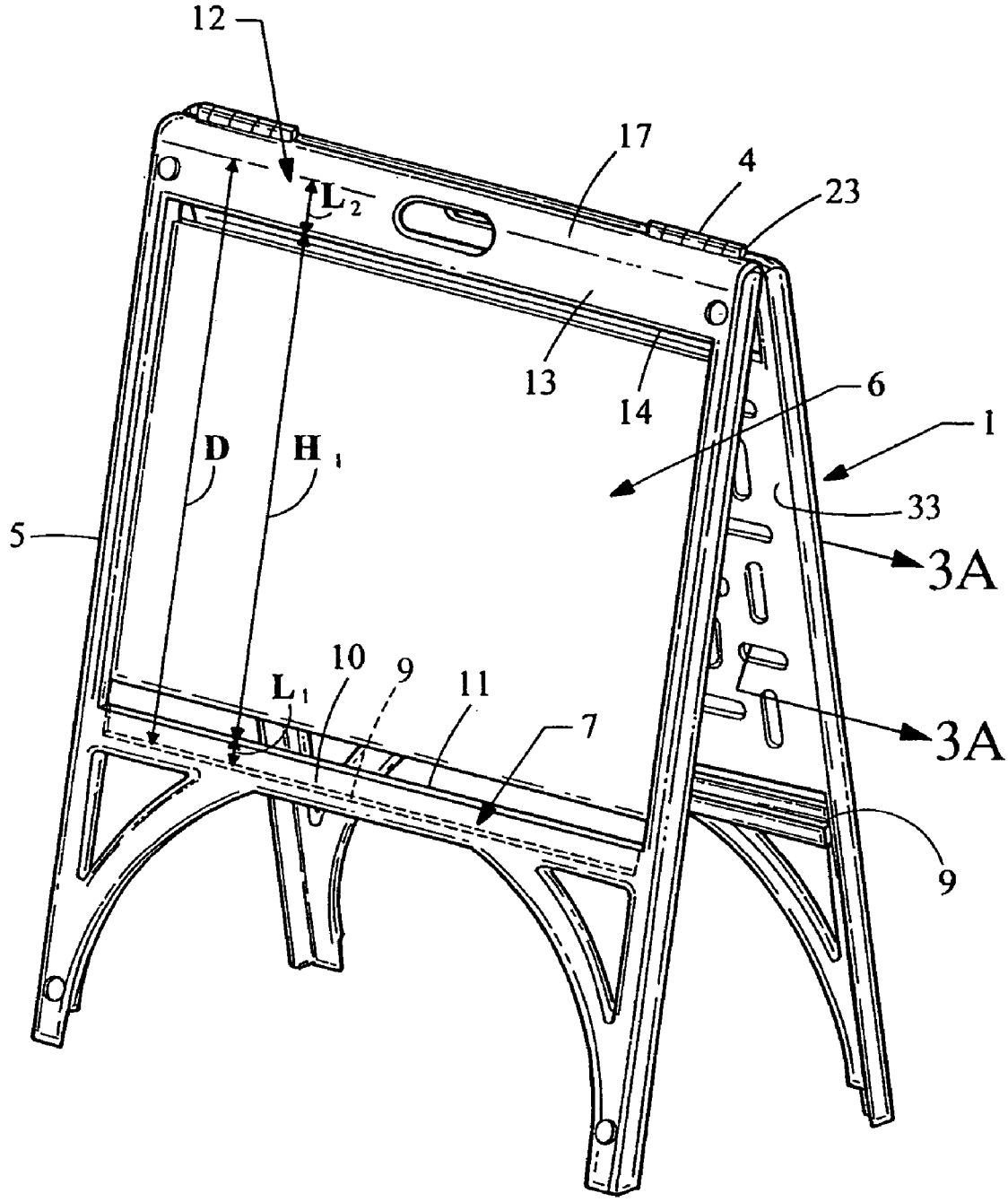
FIG. 3 is a perspective view of another embodiment of the sign stand.

Another embodiment is shown in FIG. 3. The construction and operation of this sign frame assembly is similar to that previously described, and the basic physical description will not be repeated. In this example, the front surface 13 of the upper cross bar 12 extends from a lower edge 14 so as to abut, to be overlapped by, or to be continuous with the top portion 17 of the sign frame. A space may be left between an upper edge of the upper cross bar 12 and the top portion 17 of the sign frame without departing from the teachings herein.

The width W between the side legs 5 is determined as previously described. A distance D is the sum of the distance H1, the distance L1 and the distance L2, where H1 is the distance between the upper edge 11 of the lower cross bar 7 and the lower edge 14 of the upper cross-bar 12; L1 is the distance between the upper surface of the interior lower surface 9 and the upper edge 11 of the lower cross-bar 7; and, L2 is the distance between the lower edge 14 of the upper cross-bar 12, and approximately the intersection of the plane defined by the outward facing surface 32 of the panel 6 with an inner surface of the top portion 17.

The sign 25 is dimensioned such that the sign width is less than or equal to W, and the sign height is H1 plus L1, plus some distance which is less than or equal to L2, where L2 is dimensioned to be greater than L1. The visible display area of the sign is up to W in width and extends from a distance L1 above the bottom edge 27 of the sign to a height of L1 plus H1 above the bottom edge of the sign.

Figure 3A:
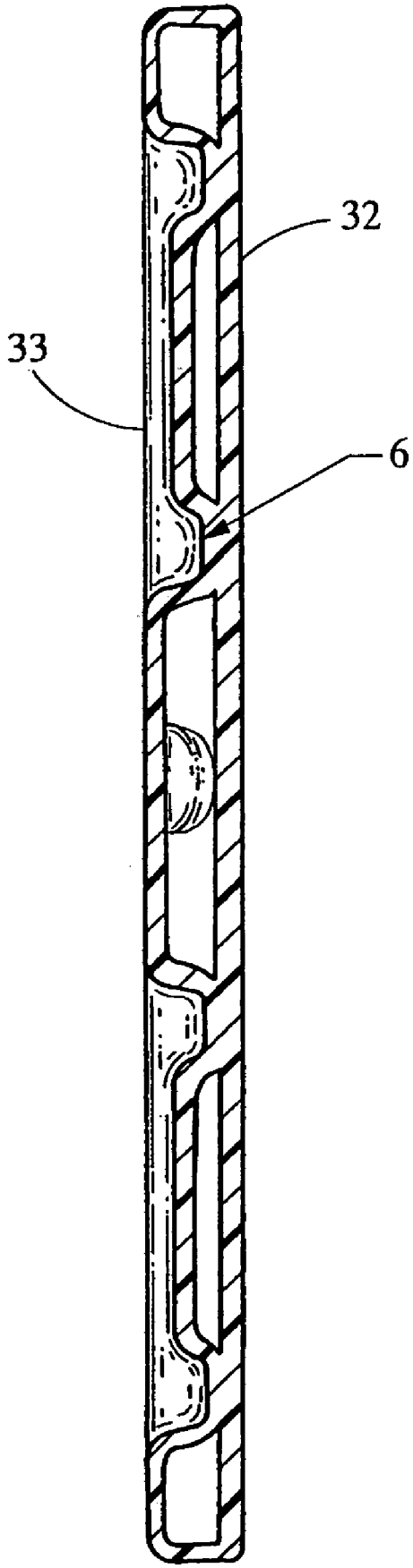
FIG. 3A is a detail cross-section of one construction approach for a frame panel.

FIG. 3A illustrates an example of corrugations in the panel.

A method of insertion of a sign 25 into the frame receptacle 8 shown in FIG. 3 will now be described. A sign 25, having appropriate planar dimensions, and having a thickness less than or equal to S is placed substantially parallel to the panel 6 such that the upper edge 28 is lower than the lower edge 14 of the upper cross bar 12. In this position, the width of the sign is such that it can be accepted in the receptacle space W between the opposing inner edges of the two legs 5. However, the height of the sign 25 is greater than H1, and the upper cross bar 12 and the lower cross bar 7 will prevent the sign 25 from being inserted directly into the aperture of width W and height H1.

At a position lower than the lower edge 14 of the upper cross-bar 13, the upper edge of the sign 25 can be brought towards the plane defined by the facing surface 32 of the panel 6, such that the front surface of the sign 25 is closer to the plane defined by the facing surface 32 of the panel 6 than approximately the distance S. In this attitude, the sign 25 is moved upwards towards the top portion 17. This movement results in introducing an the edge 28 and an upper part of the sign 25 into the volume between the inner vertical surface of the upper cross bar 12 and the surface of the panel 6, or the extension of a plane defined thereby. When sufficient upward motion has taken place, the lower edge 27 of the sign 25 is above the upper edge 11 of the lower cross bar 7. Moving the lower edge 27 of the sign 25 towards the panel 6 or an extension of the plane defined by the facing surface 32 of the panel, results in the sign 25 becoming parallel to the panel 6 and entering the aperture defined by the width W and the height H1. Maintaining the sign in this attitude with respect to the panel 6, and translating the lower edge of the sign towards the lower cross bar 7, the lower edge 27 of the sign 25 will enter the space between the inner vertical surface of the lower cross-bar 7 and the panel 6, or the extension of the facing panel surface 32. Continuing motion in this attitude results in contact between the lower edge 27 of the sign 25 and the inner bottom surface 9. In this state, the further translational motion of the sign 25 in the direction of the distal portion of the legs 5 is prevented. The upper edge 28 of the sign 25 is retained between the inner surface of the upper cross bar 12 and the panel 6, or an extension of a plane defined by the facing surface 32 of the panel. In this state, the lower edge 27 of the sign 25 is held against the inner lower surface 9 by gravitational force, and the sign is thus retained in the receptacle 8 between the plane defined by the panel 6, the inner surfaces of the vertical portion of the lower cross-bar 7 and the upper cross-bar 12 and the inner lower surface 9. This method of insertion of the sign also may be used with the first embodiment for the sign frame as well.

More than one sign 25 may be introduced into the receptacle 8 formed in the frame, the number of signs capable of being accommodated depending on the sum of the total thicknesses of the signs and the distance S, the total thickness of the signs being less than or equal to the distance S. In this arrangement, the outward-facing surface of the last-introduced sign is that which is displayed.

Figure 4:
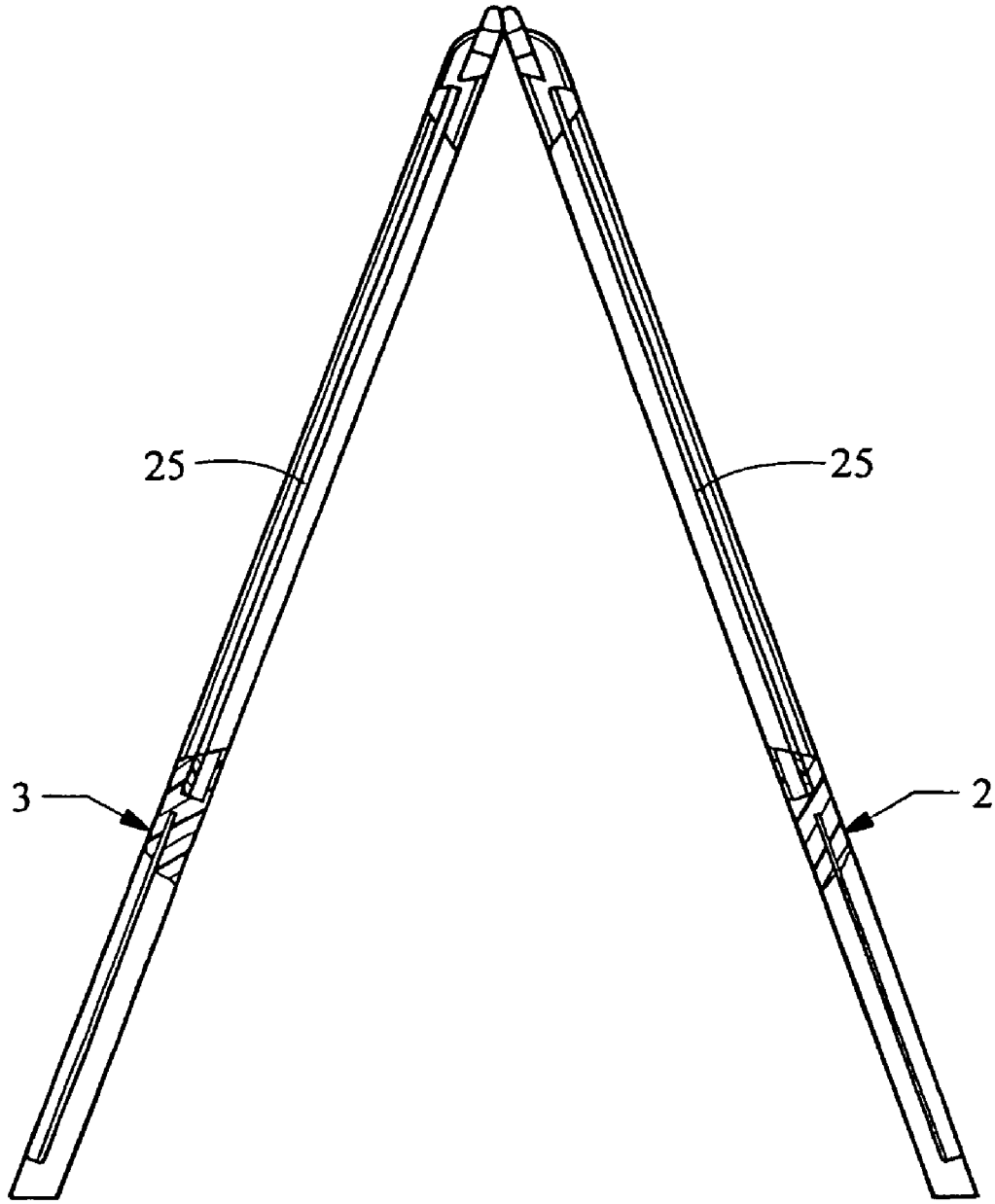
FIG. 4 is a cross-sectional side view of the embodiment illustrating a sign inserted into each of the frames.

FIG. 4 shows a side cross-sectional view of the sign stand in a deployed position, with a sign 25 having been inserted in each of the frames 2, 3.

The lower cross bar has been described as being in the form of an "L", "U" or "J", however this is merely to facilitate description. Other shapes and configurations are possible to perform the function of restraining the bottom of the sign in the vertical direction, against the force of gravity and, in the horizontal direction, in the direction of an observer facing the deployed sign so as to view the sign inserted in the frame. The term panel has been used also to facilitate the description of the planar surface deployed so as to connect the legs of the frame, and which is disposed behind the visible surface of the sign. The panel serves to retain the sign in a direction away from the observer. The lower channel may be fabricated so that one of the vertical elements of the "U" or "J" is continuous with one or more portions of the panel, without departing from the teachings herein. The panel may consist of one or more cross members, each joining the two legs, and located so as to be behind the sign when the sign has been inserted into the frame. The cross members may be fabricated in a manner similar to a single panel structure, being solid, corrugated, or perforated. The number, dimensions and location of the panel portions is a design consideration, based, for example, on the sign material, structural and environmental factors.

In embodiments where a lower edge of the frame panel, or a panel member is present at a position lower than the lower edge of the upper cross bar, the method of insertion can include bringing the upper edge 28 of the sign 25 into contact with the facing surface 32 of the panel prior to guiding it upwards into the gap between the panel, or the plane which is an extension of the panel, and the inner surface of the upper cross bar 12. Making physical contact between the sign and the panel surface can be a convenient method of ascertaining that the upper edge of the sign is positioned so as to enter the gap.

The legs 5 of the frame may be constructed so as to be hollow, and have an aperture into which sand or similar material may be introduced so as to increase the weight of the frame so that it resists the overturning force of the wind.

Figure 5:
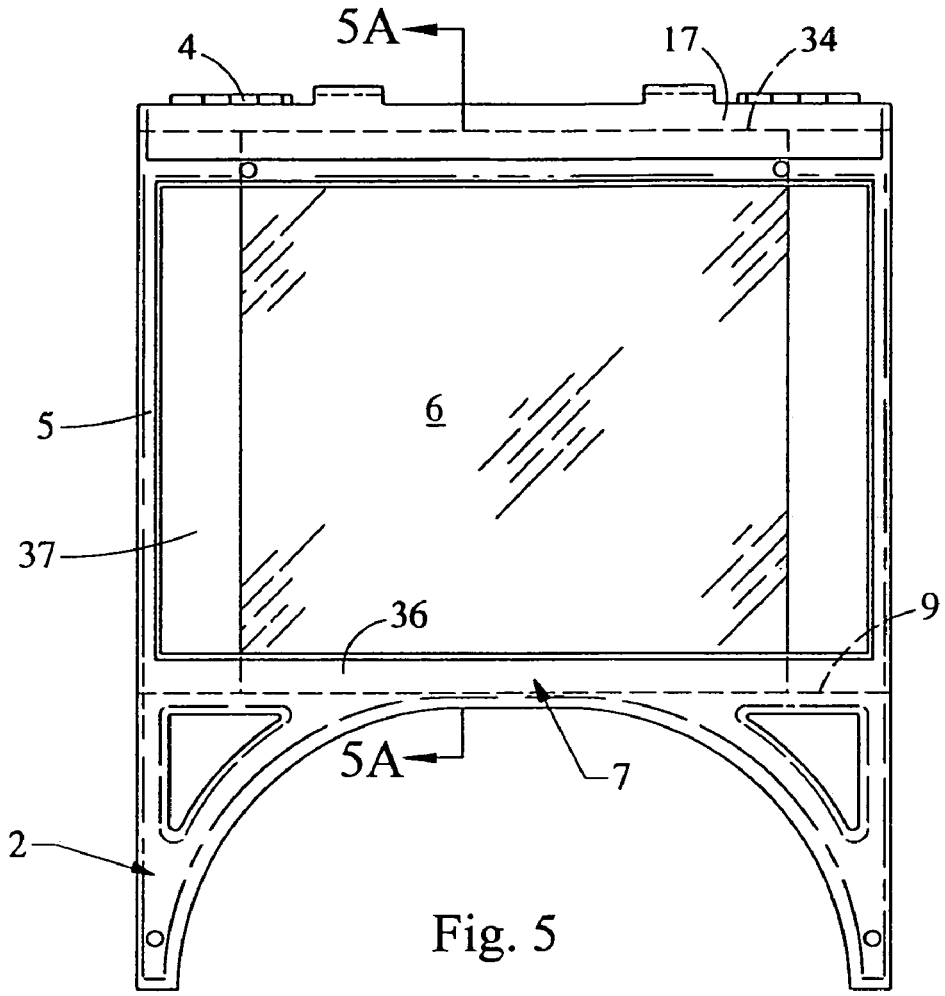
FIG. 5 is a view of yet another embodiment of the sign stand.
Figure 5A:
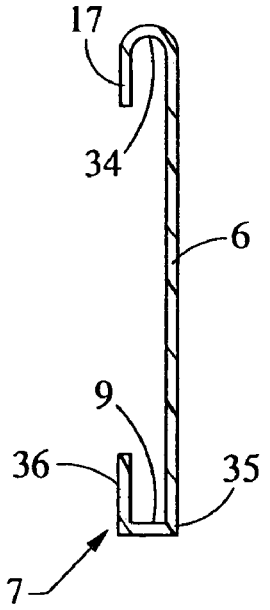
FIG. 5A is a cross-sectional view of the embodiment.

In another aspect, shown in FIG. 5, the panel 6 may be attached between a top of the sign frame 17 and edge 35 of horizontal ledge 9 of the bottom cross bar 7 that is distal from the vertical surface of the bottom cross bar 36. In embodiment, the top cross bar and the top of the sign frame have been combined, although they may remain separate, as previously shown. The panel 6 does not connect between the opposing legs 5, but such a connection is not precluded, in which situation there will not be an opening 37, as distinguished from the configuration shown in FIG. 5. Where the vertical dimensions are in accordance with the teachings of the embodiment of FIG. 3, a sign may be inserted or removed from the receptacle through the aperture thereof. Alternatively a slot may be formed in the top of the frame opposing the surface 35 and the sign inserted in a manner similar to that described in FIG. 2. The hinge 4 may not be present if the sign stand is intended to be used as a single frame, either with a base (not shown) attached to the base of the legs 2, or being filled with holes or other means such as hooks for mounting on a wall surface.

Figure 6:
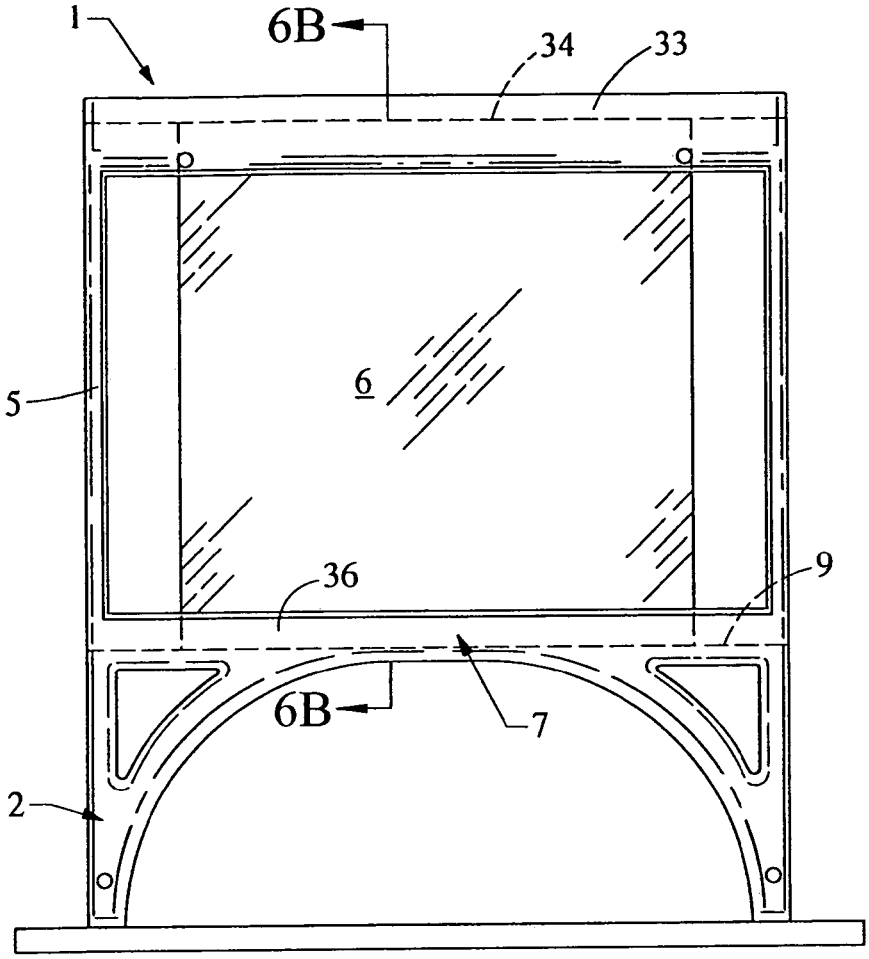
FIG. 6 is a view of a further embodiment of the sign stand.
Figure 6B:
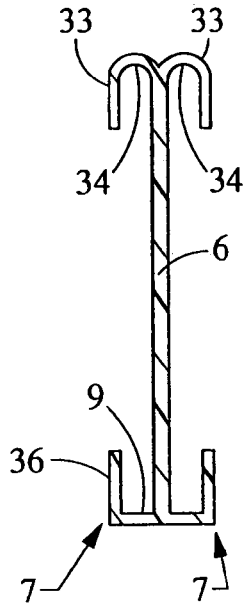
FIG. 6B is a plan view of the embodiment.
Figure 6A:
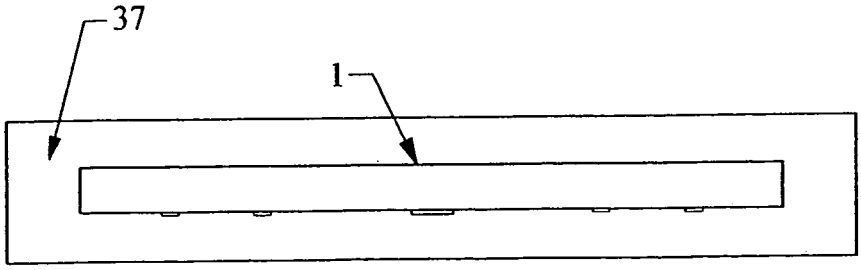
FIG. 6A is a cross-sectional view of an aspect of the embodiment.

In yet another aspect, shown in FIG. 6, the panel 6 may be connected between a pair of top portions 33, and a pair of bottom crossbars 7, so that a sign may be inserted in the frame 1 of a sign stand from a front side and a back side. The frnt and back sides may be symmetrical about the plane of the panel, and indistinguishable from each other. Alternatively, different aperture openings may be formed in each of the sides. A sign frame having the attributes of that of FIG. 6 may be mounted to a base 37, intended to hold the sign in a generally upright position so that the signs on both sides may be viewed by suitably positioned observers. The connection (not shown) between the frame legs 1 and the base 37 may be such that the sign may be detached from the base, and may include a spring to aid in the resistance of the sign to overturning due to wind forces. A slot may be provided opposite the surface 34 dimensioned such that a sign may be inserted into a frame receptacle form the top, as an alternative to the dimensioning would permit the sign to be inserted through the aperture between the top of the sign and the lower cross bar 7. Fitting for hanging the sign may be provided.

Figure 7:
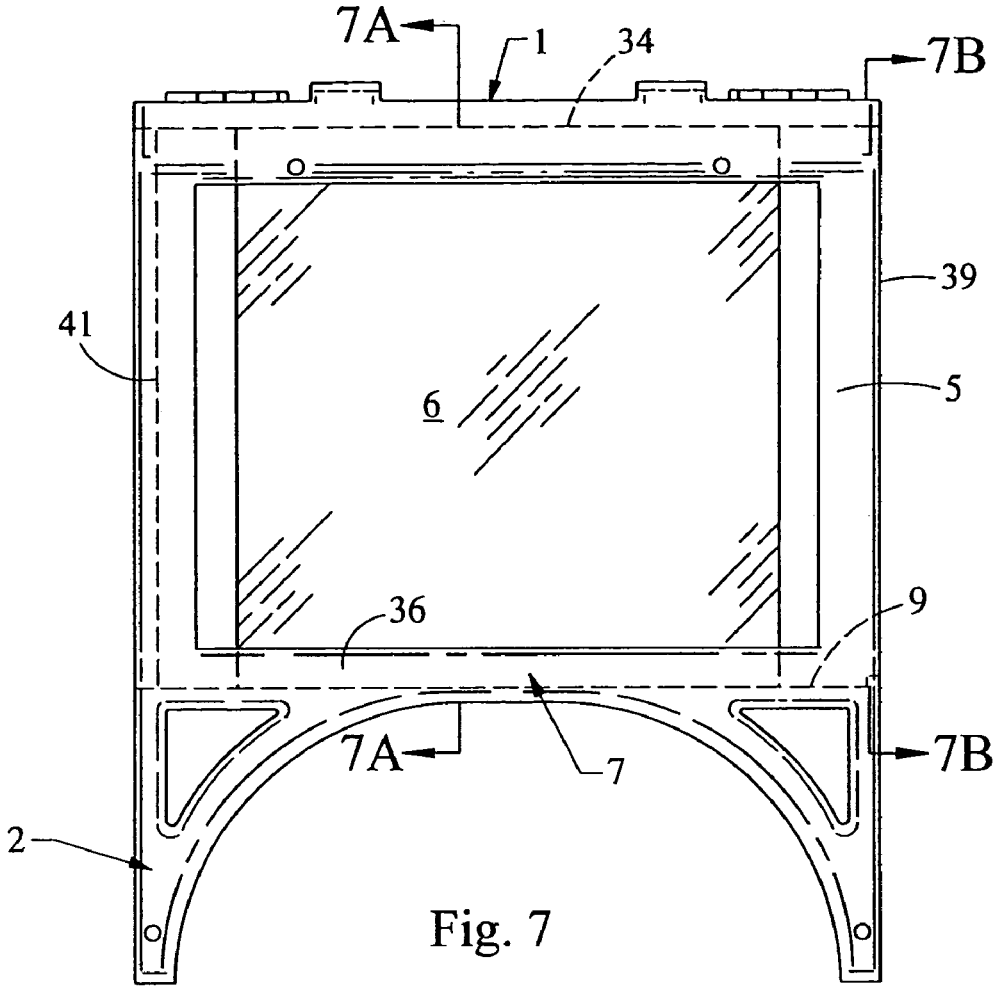
FIG. 7 is a view of another embodiment of the sign stand.
Figure 7A:
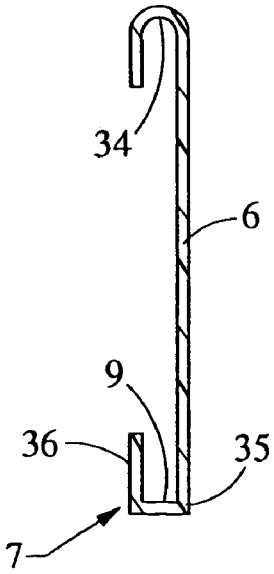
FIG. 7A is a cross-sectional view of an aspect of the embodiment.
Figure 7B:
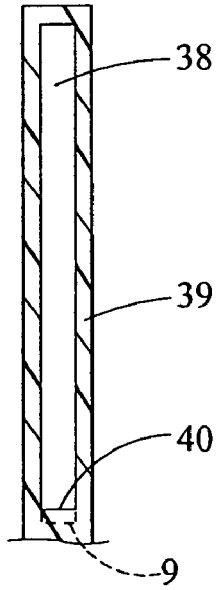
FIG. 7B is a cross-sectional view of another aspect of the embodiment.

In a further aspect, as shown in FIG. 7, the construction is similar to that of FIG. 5, and only the significant differences will be described. A slot 38 is provided in a side 39 of one of the frame legs 5, the slot being disposed such that it occupies a plane defined by the outward surface of the panel 6, and the grooves 34 and 9. The length of the slot is sufficient to accommodate the vertical dimension of a sign to be inserted in the frame, and it may be desirable to position the lower edge 40 of the slot slightly higher than the surface of the4 lower groove 9. A suitably dimensioned sign may be inserted into the frame receptacle and the sign will come to rest on the surface of the lower groove 9, and be retained in the sign by the sign top 34, the lower cross bar 7, the groove 9 and the portion of the side 5 having the slot 38 which lies between the lower edge of the slot 40 and the upper surface of the groove 9. In this embodiment, the leg opposite the leg with the groove may have several configurations. A recess 41, similar to the groove 9 may be formed such that the sign may slide some distance into the leg having the recess 41 before being restrained from further sliding motion, the resistance indicating to the user that the sign has been fully inserted into the frame receptacle. Alternatively, no groove may be provided and the leg 5 opposite to the leg 5 having the slot 38 has a continuous surface. In this instance, the sign motion will be stopped when it has filled the receptacle in the horizontal direction. Other variants of the arrangements may be combined with this configuration, including the hinges, the back-to-back symmetry, and the connection of the panel 6 to the sides rather than the top and bottom cross bar of the frame, or the connection of the panel 6 on all four sides to parts of the sign frame.

Although only a few exemplary embodiments of this invention have been described in detail above, those skilled in the art will readily appreciate that many modifications are possible in the exemplary embodiments without materially departing from the novel teachings and advantages of the invention. Accordingly, all such modifications are intended to be included within the scope of this invention as defined in the following claims.

What is claimed is:

1. A sign stand frame, comprising:

a pair of legs disposed parallel to each other;

an upper cross bar;

a lower cross bar, the lower cross bar having a channel shape; and a panel, wherein the upper cross bar connects the pair of legs at a location near an upper end of the legs, the lower cross bar connects the pair of legs at a location between the upper cross bar and a lower end of the legs, the panel connects the pair of legs and is disposed such that a sign receptacle is formed between each of an inner vertical surface of the upper cross bar, an inner vertical surface of the lower cross bar, and a first plane coincident with the facing surface of the panel and, wherein the inner surface of the upper cross bar and the first plane define an aperture having a distance S, dimensioned such that a sign of thickness less than or equal to the distance S is insertable therein.

2. The frame according to claim 1, wherein the channel shape is in the form of one of a "U" an "L", or a "J".

3. The frame according to claim 1, wherein a portion of the lower cross bar is integral with the panel.

4. The frame according to claim 1, wherein the panel is comprised of at least one member whose vertical dimension is less than a distance between a lower edge of the upper cross bar and an upper edge of the lower cross bar.

5. The frame according to claim 1, wherein the panel has a corrugated cross section.

6. The frame according to claim 1 wherein a gap distance S, between the first plane and a second plane, the second plane containing the inner vertical surface of the upper cross bar and the inner vertical surface of the lower cross bar, is greater than a thickness of a sign.

7. The frame according to claim 1, wherein the inner surface of the upper cross bar and the first plane define an opening having a distance S, dimensioned such that a thickness of a sign is less than S.

8. The frame according to claim 1, wherein in combination with a sign, a sign is introduced into the sign receptacle between the first plane and a second plane, the second plane containing an inner vertical surface of the upper cross bar and the inner vertical surface of the lower cross bar, and a lower edge of the sign is supported by a horizontal inner surface of the lower cross-bar.

9. The frame according to claim 8, wherein the sign is dimensioned such a thickness of the sign is less than or equal to a distance S; a width is less than or equal to the distance between inner edges of the pair of opposing legs; and, a height of the sign is greater than the sum of a distance between an upper edge of the lower crossbar and a lower edge of the upper cross bar and a distance between a horizontal inner surface of the lower cross bar and the upper edge of the lower cross bar.

10. The frame according to claim 1 wherein the pair of legs, the upper cross bar, the lower cross bar, and the panel are fabricated from plastic.

11. The frame according to claim 1, wherein the panel has an aperture extending between the facing surface and an opposing surface.

12. The frame according to claim 1, wherein the panel fixably communicates with the pair of legs.

13. The frame according to claim 12, wherein the panel is formed integrally with the pair of legs.

14. A sign frame assembly, comprising:

a first frame and a second frame, the frames having top portions which are journally connected;

at least one of the frames having side legs, the side legs approximately orthogonal to the top portion, and the side legs being approximately parallel to each other;

a lower cross bar joining the side legs and an upper cross bar disposed parallel to the lower cross bar and joining the side legs, the side legs, an inner surface of the lower cross bar and an inner surface of the upper cross-bar approximately defining a surface of a first plane; and a panel connecting the side legs, the panel being disposed such that a second plane approximately defined by a facing surface of the panel is displaced by a distance S from the first plane; and a vertical extension of the top portion of the first frame and of the second frame dimensioned such that it extends above a journal assembly, and so that the vertical extension on the first frame and the second frame make contact when the frames are journally rotated with respect to each other to form an acute angle, wherein the lower cross bar has a first surface orthogonal to the first plane the first surface and facing the top portion, extending from an inner vertical portion of the lower cross bar towards the second plane, and the distance S is dimensioned such that a sign having a thickness of less than S is insertable between the first plane and the second plane.

15. The sign stand according to claim 14, wherein a sign is introduced into a receptacle between the first and the second plane, and where a lower edge of the sign is supported by the first surface of the lower cross-bar.

16. The sign stand according to claim 15, wherein the sign is dimensioned such a thickness is less than or equal to the distance S; a width is less than or equal to the distance between inner edges of the side legs; a height is greater than the sum of a distance between the upper edge of the lower crossbar and the lower edge of the upper cross bar, plus a distance between the first surface and the upper edge of the lower cross bar; and, the height is less than a distance between the first surface and approximately the intersection of the second plane with the top portions of the frames, less the distance between the first surface and the upper edge of the lower cross bar.

17. The sign stand according to claim 14, further comprising a support cross bar, which connects the two legs and is disposed below the lower cross bar.

18. The sign stand according to claim 14, wherein a distance between a lower edge of the upper cross bar and approximately an intersection of the second plane with the top portion of the frame is greater than a distance between the first surface of the lower cross bar and an upper edge of the lower cross bar.

19. The sign stand according to claim 14, wherein the pair of legs, the upper cross bar, the lower cross bar, and the panel are fabricated from plastic.

20. The sign stand according to claim 14, wherein an outer facing surface of the upper cross bar is continuous with an outer facing surface of the top portion.

21. The frame according to claim 1, wherein the top cross bar is formed integrally with the pair of legs.

* * * * *

UNITED STATES PATENT AND TRADEMARK OFFICE

CERTIFICATE OF CORRECTION

PATENT NO. : 7,337,569 B2
APPLICATION NO. : 11/198476
DATED : March 4, 2008
INVENTOR(S) : Geoffrey M. Glass It is certified that error appears in the above-identified patent and that said Letters Patent is hereby corrected as shown below:

On the Title Page

In column 1, item (75), Inventor, delete "Skokie" and substitute --Wheeling-- in its place.

Signed and Sealed this

Fifth Day of August, 2008

JON W. DUDAS
*Director of the United States Patent and Trademark Office*